US007470047B2

(12) United States Patent
Lin et al.

(10) Patent No.: US 7,470,047 B2
(45) Date of Patent: Dec. 30, 2008

(54) LIGHTING DEVICE WITH INTEGRATION SHEET

(75) Inventors: Jian-Shian Lin, Yilan (TW); Hsiu-Chen Hsu, Tainan (TW); Ming-Fong Chen, Hsinchu (TW); Ben-Sheng Lin, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 251 days.

(21) Appl. No.: 11/349,158

(22) Filed: Feb. 8, 2006

(65) Prior Publication Data

US 2006/0232976 A1 Oct. 19, 2006

(30) Foreign Application Priority Data

Apr. 15, 2005 (TW) ..... 94111950 A

(51) Int. Cl.
*F21V 5/02* (2006.01)

(52) U.S. Cl. ..... 362/339; 362/329; 362/332

(58) Field of Classification Search ..... 362/329, 362/294, 339, 332, 330, 607, 558, 337, 331, 362/355; 359/599
See application file for complete search history.

(56) References Cited

U.S. PATENT DOCUMENTS 4,390,934 A * 6/1983 Willing ..... 362/291
4,704,004 A * 11/1987 Nosker ..... 349/67
6,183,114 B1 * 2/2001 Cook et al. ..... 362/294
6,206,544 B1 3/2001 Costa ..... 362/242
6,402,346 B1 * 6/2002 Liao et al. ..... 362/294
2004/0202828 A1 * 10/2004 Saito et al. ..... 428/195.1
2006/0050512 A1 * 3/2006 Nakagawa ..... 362/264

* cited by examiner

*Primary Examiner*—Bao Q Truong
(74) *Attorney, Agent, or Firm*—WPAT.P.C.; Justin King

(57) ABSTRACT

A light device with integration sheet is disclosed, which comprises: a light source; and at least a sheet, each being disposed at the light emitting end of the light source and comprising a plurality of light diffusion zones; wherein each light diffusion zone has a plural arrays of microstructures arranged on the surface thereof, and each array of microstructures is capable of changing the diopter of the corresponding light diffusion zone. By controlling the distribution of the plural arrays of microstructures, the Gaussian distribution of the light source can be improved while collimating the scattered light beams to the intended illuminating area of the lighting device and diffusing the light beams emitting from the center of the light source to the same so that not only the luminous efficacy of the lighting device is enhanced, but also the uniformity of the illuminance of the lighting device is improved.

15 Claims, 8 Drawing Sheets

LIGHTING DEVICE WITH INTEGRATION SHEET

FIELD OF THE INVENTION

The present invention relates to a lighting device, and more particularly, to a lighting device with integration sheet capable of using a sheet having a plural arrays of microstructures arranged thereon, the sheet being designed basing on an energy distribution of a light source calculated by a means of integration, to improve the uniformity of the light beams discharged form the lighting device while enhancing the luminance of the same.

BACKGROUND OF THE INVENTION

It is known that the illumination quality and the property of the light of a lighting device are related to the way that light beams generated by the lighting device are being transmitted. Lighting analysis of a lighting device incorporates lighting levels and lighting quality considerations such as glare, uniformity of illuminance, and color rendition into a lighting survey. Generally, a lighting device uses reflecting screens and shielding screens to control the directions of the light emitted therefrom and thus enable the luminous intensity of the same to be distributed uniformly. Conventionally, lighting devices usually adopt semi-transparent plastic screen or louver as shielding screen for reducing glare. However, since the semi-transparent plastic screen is inferior in that it is capable of not only absorbing light, but also diffusing light, the lighting device adopting semi-transparent plastic screen as shielding screen will have poor energy efficiency and glare control. In addition, the light source of a conventional lighting device must be positioned precisely at a specific location so as to enabling the luminous intensity of the lighting device to be distributed as desired.

Please refer to FIG. 1, which is a light box having a Fresnel lens 1 disclosed in U.S. Pat. No. 4,704,004. The light box 10 of FIG. 1 uses a parabolic reflector 14 for enabling light beams to be discharged therefrom parallelly. The light source 12 arranged in the light box 10 comprises a line source such as a fluorescent tube, which can be adopted as the light source of a liquid crystal panel. However, since the goal of the light box 10 is to discharge parallel rays, the types and structures of the light source are thus limited.

In addition, an illumination fixture, disclosed in U.S. Pat. No. 6,206,544, uses the cooperative operation of a cold cathode tube and a catadioptric lens to collect and redirect light beams toward a Fresnel lens arranged at the light emitting end of the illumination fixture for directing and spreading the emitted light to fill an illumination field. Although the direction and distribution of the emitted light is controllable by the catadioptric lens, it is bulky and complicated that is not cost effective.

Therefore, it is in great need to have a lighting device with integration sheet capable of overcoming the aforesaid shortcomings.

SUMMARY OF THE INVENTION

It is the primary object of the present invention to provide a lighting device with integration sheet capable of collimating the scattered light beams to incident on an intended illuminating area and diffusing the light beams emitting from the center of the light source to incident on the same by the operations of the partitions formed on the sheet, so that not only the luminous efficacy of the lighting device is enhanced, but also the uniformity of the illuminance of the lighting device is improved.

Another object of the invention is to provide a lighting device comprising a sheet with a plurality of microstructures formed thereon, capable of enabling the lighting device to have uniformly distributed luminance by designing various microstructures with different base widths.

To achieve the above objects, the present invention provides a light device with integration sheet, which comprises: a light source; and at least a sheet being disposed at the light emitting end of the light source, each comprising a plurality of light diffusion zones; wherein each light diffusion zone has a plural arrays of microstructures arranged on the surface thereof, and each array of microstructures is capable of changing the diopter of the corresponding light diffusion zone.

Preferably, each light diffusion zone is a Fresnel lens.

Preferably, a microstructure array of the plural arrays of microstructures is an array of prism having a profile defined by a curve function, wherein the profile defined by the curve function can be a shape selected form the group consisting of a triangle, a circle, a rhombus, a square and the combinations thereof.

Preferably, the sheet is made of a transparent material, such as polymers or glass materials. Moreover, the polymer is a material selected from the group consisting of a polymethyl methacrylate (PMMA), a polycarbonate (PC) and a polystyrene (PS).

Preferably, the microstructures of any two different arrays out of the plural arrays is specified according to a manner selected from the group consisting of: enabling the base width of a microstructure of one of the two array to be equal to that of another array; enabling the base width of a microstructure of one of the two array to be different from that of another array; and the combinations thereof.

Preferably, the sheet further comprises a heat conducting structure, which can be a plurality of apertures.

Preferably, the sheet further comprises a heat conducting structure, which can be a plurality of recesses, each enabling an aperture to be formed between a screen and the sheet while combining the screen with the sheet.

Other aspects and advantages of the present invention will become apparent from the following detailed description, taken in conjunction with the accompanying drawings, illustrating by way of example the principles of the present invention.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

In order to not only improve the luminous efficacy of a lighting device by better controlling the directions of the light beams discharged therefrom, but also enhance the uniformity of the illuminance of the lighting device, an integration sheet is added to the lighting device as disclosed in the present invention. Basing on a calculation of energy distribution of a light source using an integration means to according the conservation of energy law, most of the light beams generated by the light source are guided to illuminate on the integration sheet by a reflecting screen arranged surrounding the light source. Thereafter, the scattered light beams can be collimated to incident on an intended illuminating area of the lighting device and the light beams emitting from the center of the light source can be diffused to incident on the same by the operations of the partitions formed on the sheet, so that the luminous efficacy of the lighting device is enhanced. Moreover, by designing various microstructures with different base widths to be formed on the sheet, the sheet is capable of enabling the lighting device to have uniformly distributed luminance.

Figure 1:
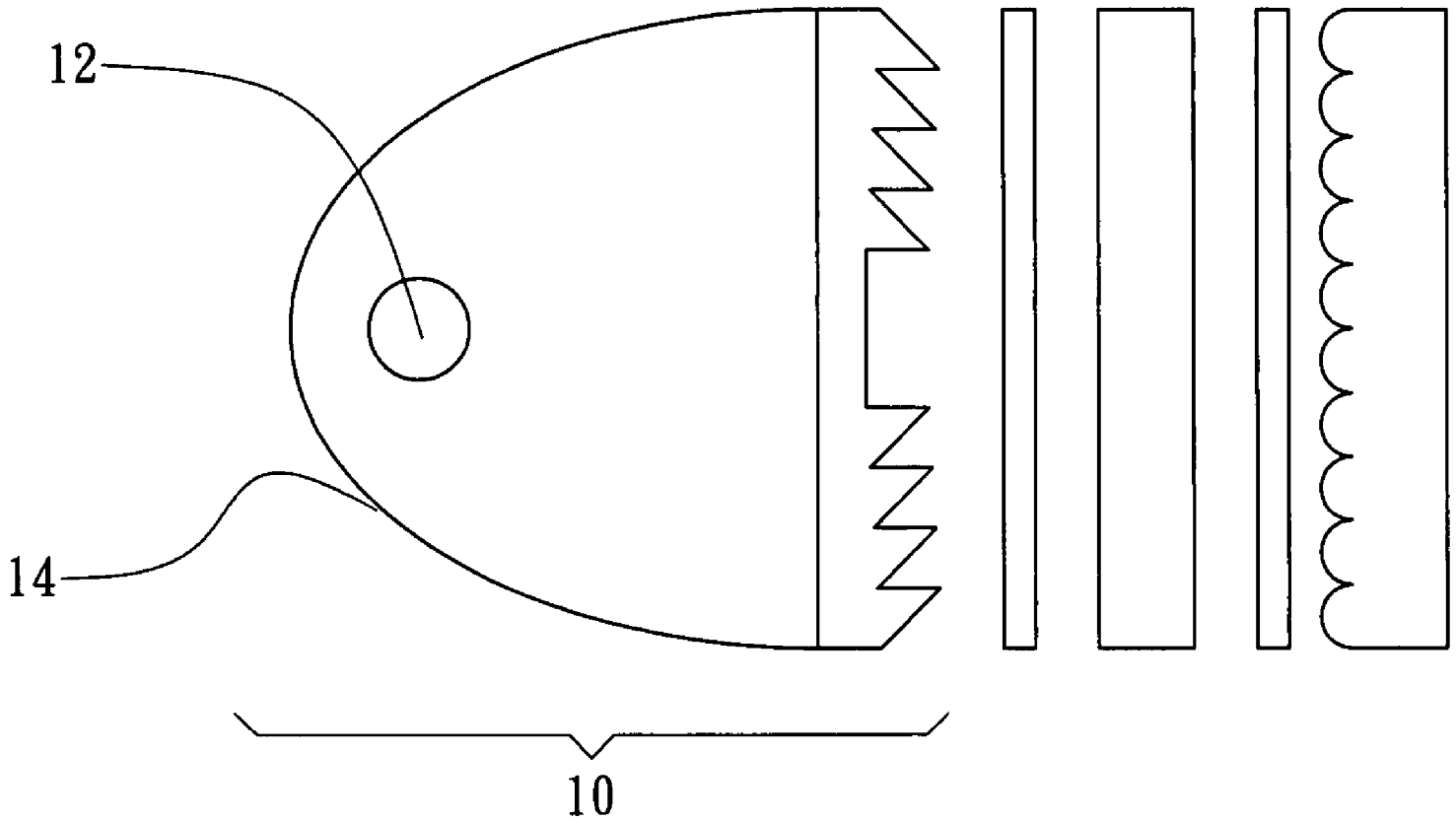
FIG. 1(Prior Art)
FIG. 1 is a light box having a Fresnel lens 1 disclosed in U.S. Pat. No. 4,704,004.
Figure 2A:
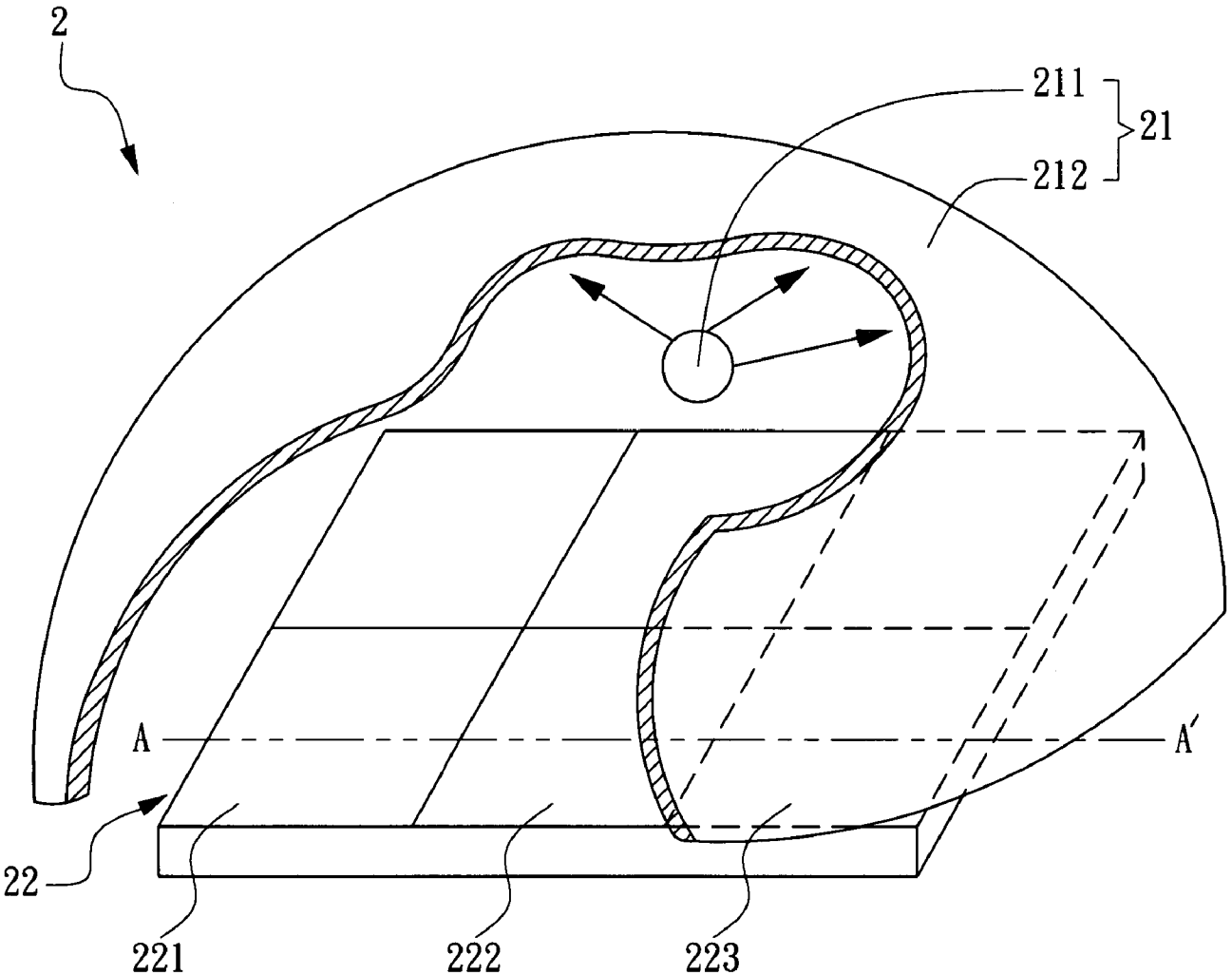
FIG. 2A is a schematic diagram illustrating a lighting device with integration sheet according to a first preferred embodiment of the invention.

Please refer to FIG. 2A, which is a schematic diagram illustrating a lighting device with integration sheet according to a first preferred embodiment of the invention. The lighting device 2 of FIG. 2A comprises: a light source 21 having a luminous body 211 and a reflecting screen 212; and a sheet 22, being disposed at the light emitting end of the light source 21, each comprising a plurality of light diffusion zones, represented by the three light diffusion zones 221, 222, 223; wherein each light diffusion zone has a plural arrays of microstructures arranged on the surface thereof, and each array of microstructures is capable of changing the diopter of the corresponding light diffusion zone. The sheet 22 is made of a transparent material, such as, polymers or glass materials. Moreover, the polymer is a material selected from the group consisting of a polymethyl methacrylate (PMMA), a polycarbonate (PC) and a polystyrene (PS). Furthermore, the sheet 22 is formed from die-casting and hard baking a transparent material coated with a layer of UV glue.

Figure 2B:
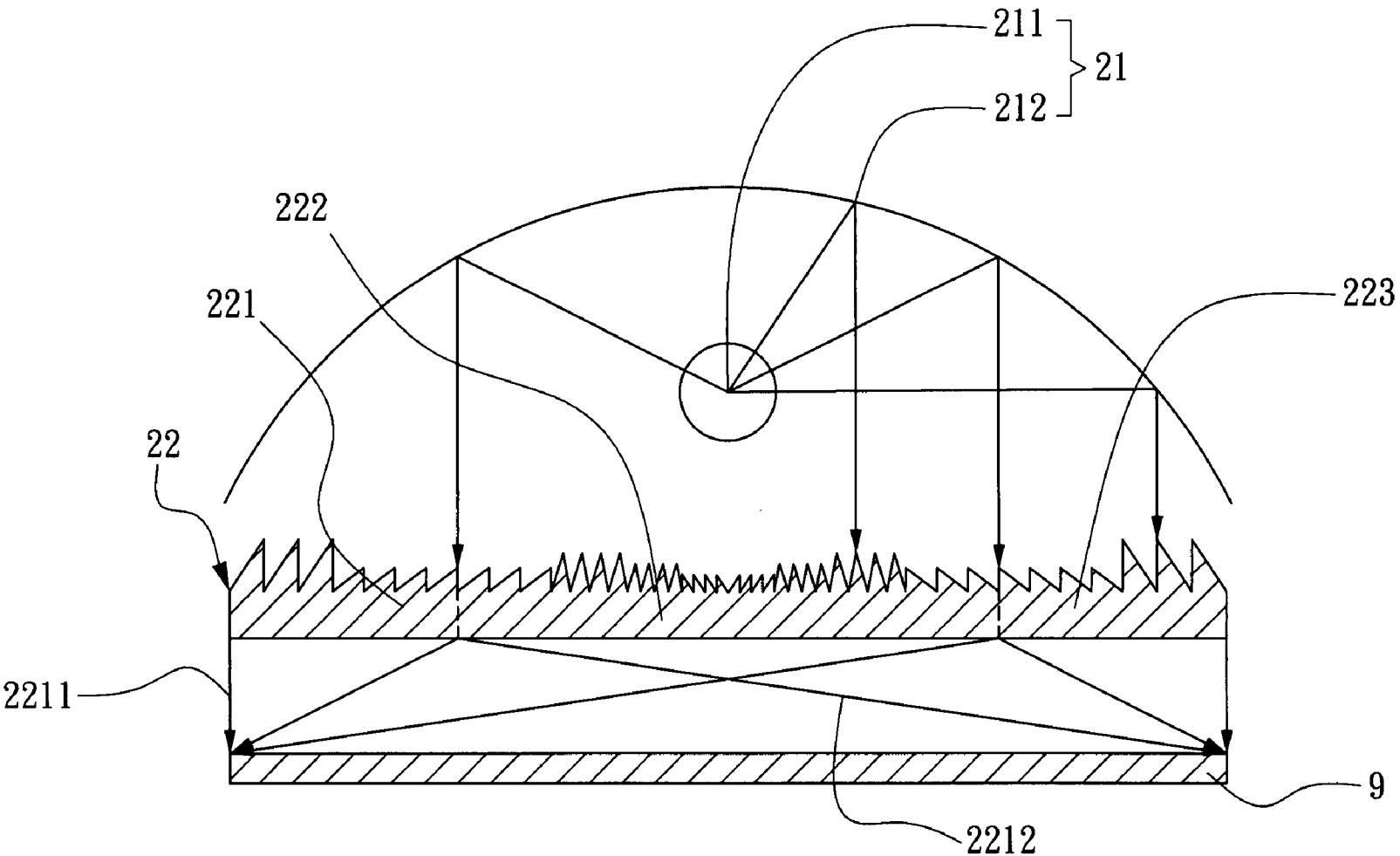
FIG. 2B is a sectional diagram illustrating the A-A' section of the sheet of FIG. 2A.

Since the light intensity of the light discharged from the luminous body 211 is not uniformly distributed, it is intended to use the sheet 22 for enabling the light beams emitting from the center of the light source 22 to be diffused uniformly to intended illuminating area so that the luminous efficacy of the lighting device can be enhanced. Please refer to FIG. 2B and FIG. 2C, which are respectively a sectional diagram illustrating the A-A' section of the sheet of FIG. 2A and a schematic sectional view of a plurality of arrays of microstructures formed on the sheet of FIG. 2A. In FIG. 2B, each of the three light diffusion zones 221, 222, 223 comprises a plurality of arrays of microstructures. In the preferred embodiment shown in FIG. 2B, the arrays of microstructures can be arrays of prisms, such as those formed in the light diffusion zones 221, for enabling the light incident thereon to be diffused and incident upon the whole illuminating area 9, as illustrated by the first light path 2211 and the second light path 2212.

Figure 2C:
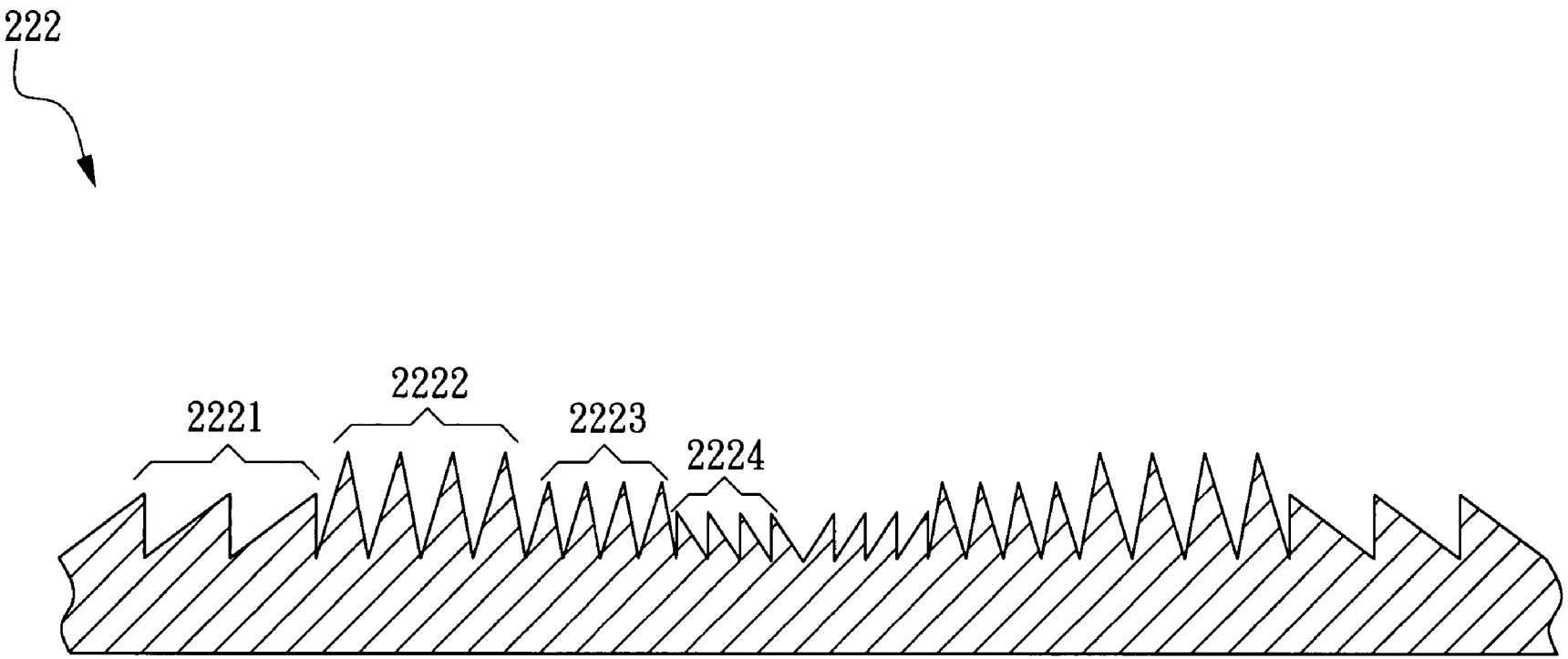
FIG. 2C is a schematic sectional view of a plurality of arrays of microstructures formed on the sheet of FIG. 2A.

In FIG. 2C, the light diffusion zones 222 is illustrated as an example which has four arrays of microstructures, i.e. a first microstructure array 2221, a second microstructure array 2222, a third microstructure array 2223 and a fourth microstructure array 2224, formed thereon. Wherein, the profile of any one microstructure of the plural arrays of microstructures is defined by the curve function, whereas the profile defined by the curve function can be a shape selected form the group consisting of a triangle, a circle, a rhombus, a square and the combinations thereof. It is noted that all the light diffusion zones 221, 222, 223 are capable of diffusing the light beams incident thereon for enabling the diffused light beams to incident upon the whole illuminating area 9 by arrays of microstructures formed thereon. Accordingly, by stacking the light beams diffused by the sheet 22, not only the uniformity of the illuminance of the lighting device is improved, but also the discharging directions of light beams generated from the light source 21 can be controlled.

Figure 3:
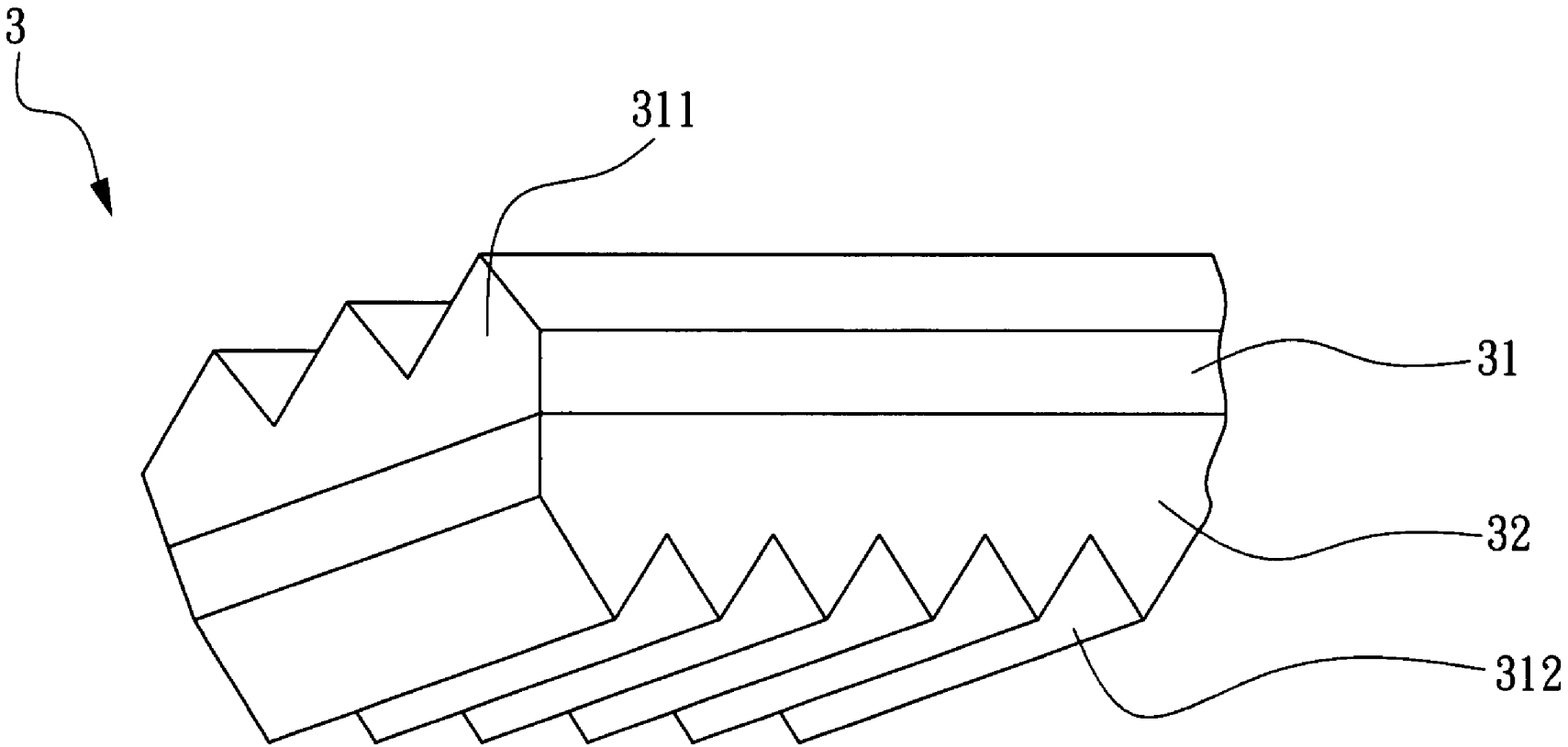
FIG. 3 is a three dimensional diagram illustrating a sheet according to a second embodiment of the invention.

Please refer to FIG. 3, which is a three dimensional diagram illustrating a sheet according to a second embodiment of the invention. In this preferred embodiment shown in FIG. 3, the sheet 3 is formed by laminating a first plate 31 and a second plate 32, whereas a microstructure array 311 is formed on a surface of the first plate 31 and another microstructure array 321 is formed on a surface of the second plate 32 opposite to the microstructure array 311. Moreover, the sheet 3 is designed to correspond to the distribution of light emitted from the lighting device, such that the contour of the sheet 3 is a shape selected form the group consisting of a hexagon, a triangle, a pentagon, a quadrangle, and the combination thereof.

Figure 4B:
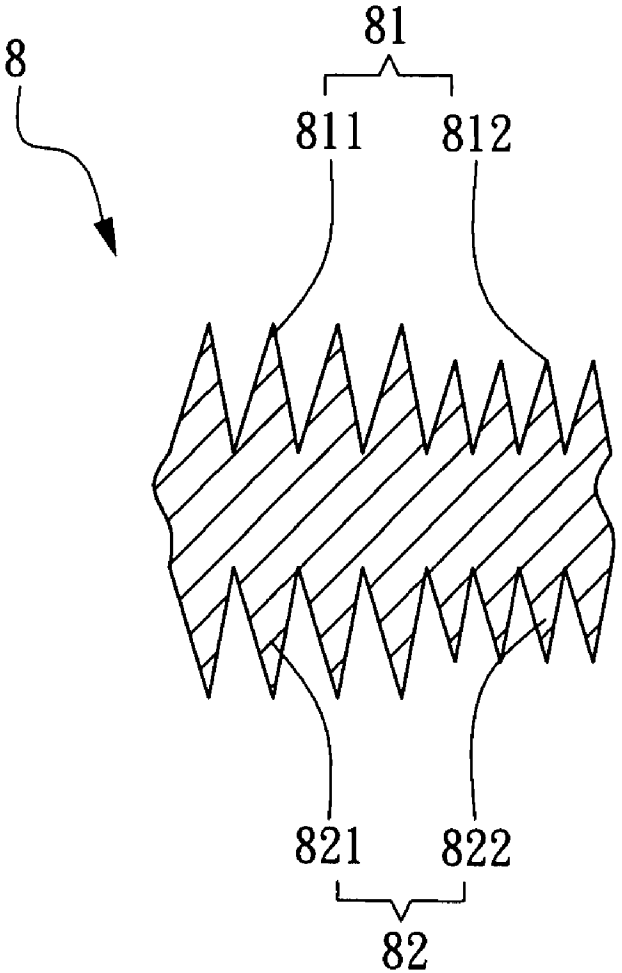
FIG. 4B is a schematic diagram illustrating the microstructures formed on a sheet according to a fourth embodiment of the invention.
Figure 4A:
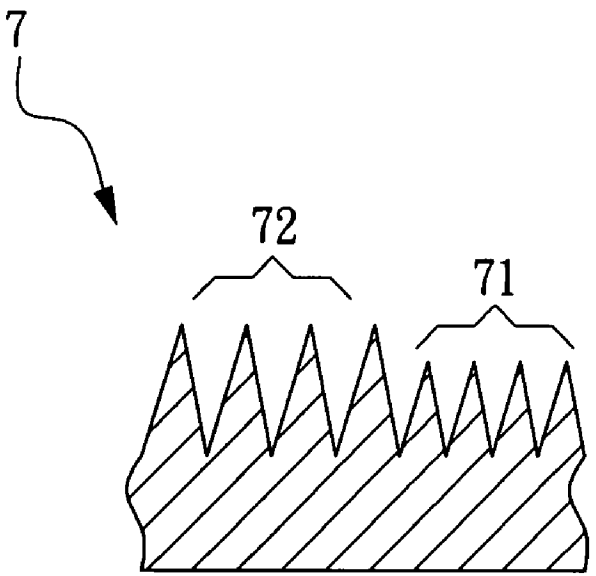
FIG. 4A is a schematic diagram illustrating the microstructures formed on a sheet according to a third embodiment of the invention.

Please refer to FIG. 4A, which is a schematic diagram illustrating the microstructures formed on a sheet according to a third embodiment of the invention. The base widths of the microstructures of any array out of the plural arrays formed on the sheet 7 can be equal to or different from that of another array, which is designed according to requirements. In FIG. 4A, the base width $d_1$ of the microstructure 71 is different from the base width $d_2$ of the microstructure 72. Please refer to FIG. 4B, which is a schematic diagram illustrating the microstructures formed on a sheet according to a fourth embodiment of the invention. In FIG. 4B, the two arrays of microstructures 811, 812 is formed on the top surface 81 of the sheet 8 while another two arrays of microstructures 821, 822 is formed on the bottom surface 82 of the sheet 8. It is noted that the arrangement of arrays of microstructures is not limited thereby, and thus can be either arranged on the top surface 81 or the bottom surface 82 as required.

Figure 5B:
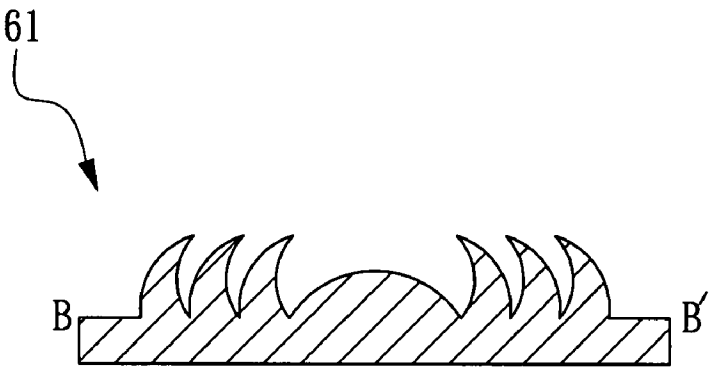
FIG. 5B is a schematic diagram illustrating the B-B' section of FIG. 5A.
Figure 5A:
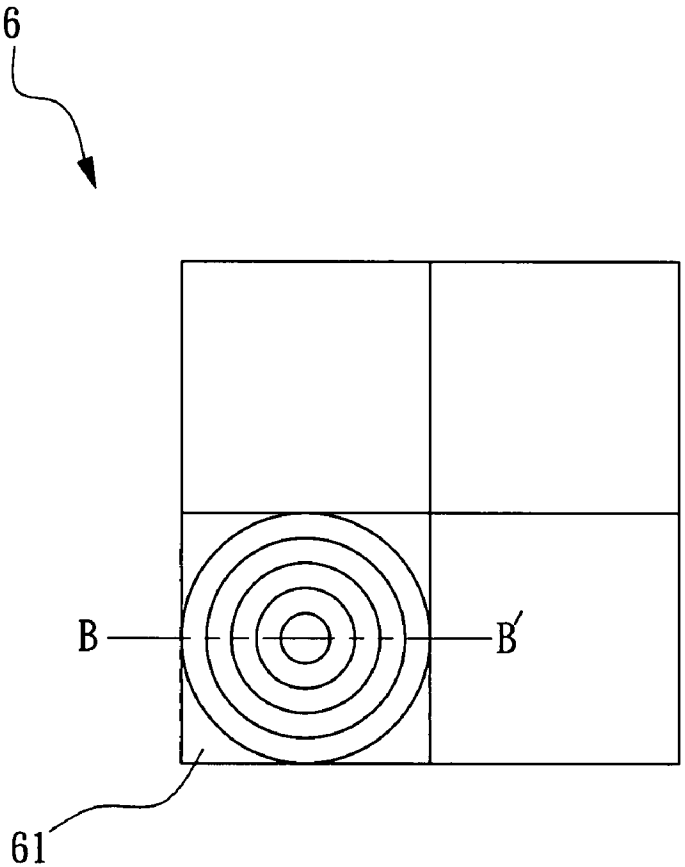
FIG. 5A is a schematic top view of a screen according to a fifth embodiment of the invention.

Please refer to FIG. 5A, which is a schematic top view of a screen according to a fifth embodiment of the invention. The sheet 6 shown in FIG. 5A comprises a plurality of light diffusion zones 61, whereas any one of the plural light diffusion zones 61 can be a Fresnel lens as shown in FIG. 5B.

Figure 6B:
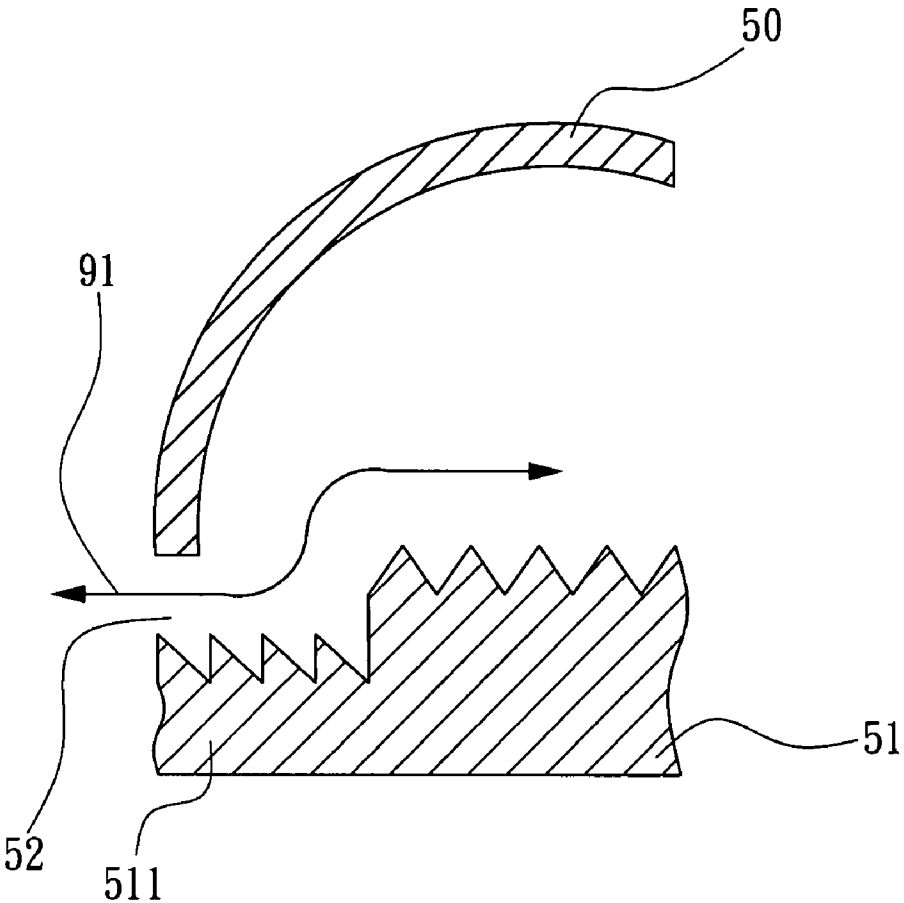
FIG. 6B is a schematic diagram depicting a heat conducing structure according to another preferred embodiment of the invention.
Figure 6A:
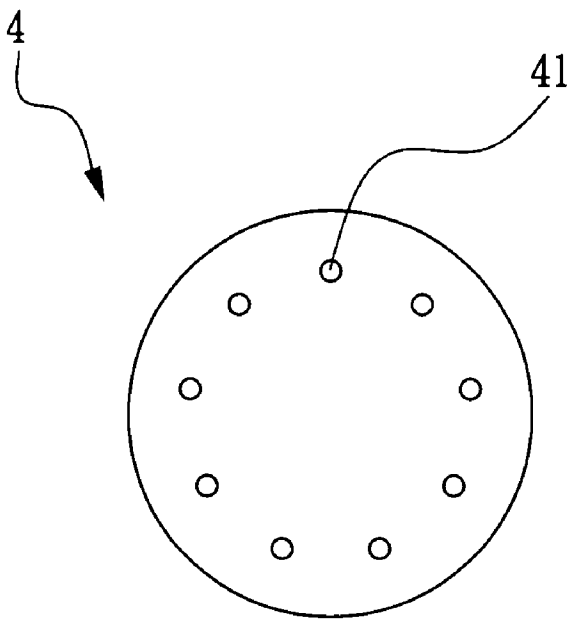
FIG. 6A is a schematic diagram depicting a heat conducing structure according to a preferred embodiment of the invention.

For enabling a lighting device to have good heat dissipating ability, apertures are formed on the sheet for conducting heat generated by the light source out of the lighting device. Accordingly, the sheet with heat conducting structure is able to reduce the hazard of overheating and thus increase the usage time of the lighting device. Please refer to FIG. 6A, which is a schematic diagram depicting a heat conducing structure according to a preferred embodiment of the invention. In the preferred embodiment shown in FIG. 6A, a plurality of apertures 41 are formed on the sheet 4 for conducting heat. Please refer to FIG. 6B, which is a schematic diagram depicting a heat conducing structure according to another preferred embodiment of the invention. In the preferred embodiment shown in FIG. 6B, a flimsy area 511 of the sheet 51, which is formed by a plurality of recesses 52, is acting as a heat conducting structure of the sheet 51 since an aperture can be formed at the flimsy area 511 of the plural recesses 52 to allow air flow 91 between a screen 50 and the sheet while combining the screen with the sheet.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A light device with an integration sheet, comprising:

a light source; and at least one sheet, each sheet being disposed at the light emitting end of the light source and comprising a plurality of light diffusion zones, wherein each light diffusion zone has a plural arrays of microstructures arranged on the surface thereof, and each array of microstructures is capable of changing the diopter of the corresponding light diffusion zone, wherein each light diffusion zone is configured to collimate the scattered light beams to incident on an intended illuminating area and diffuse the light beams emitting from the center of the tight source to incident on the intended illuminating area by the selection of zone partitions formed on each sheet, wherein the each diffusion zone includes a plurality of microstructures formed on each sheet, the microstructures being configured to produce uniformly distributed luminance by varying base widths of the microstructures.

2. The lighting device of claim 1, wherein one light diffusion zone of the plural light diffusion zones is a Fresnel lens.

3. The lighting device of claim 1, wherein one microstructure array of the plural arrays of microstructures is an array of a prism.

4. The lighting device of claim 1, wherein each microstructure of the plural arrays of microstructures has a profile defined by a curve function.

5. The lighting device of claim 4, wherein the profile defined by the curve function is a shape selected from the group consisting of a triangle, a circle, a rhombus, a square and the combinations thereof.

6. The lighting device of claim 1, wherein the contour of the at least one sheet is a shape selected from the group consisting of a hexagon, a triangle, a pentagon, a quadrangle, and the combination thereof.

7. The lighting device of claim 1, wherein the at least one sheet is made of a transparent material.

8. The lighting device of claim 7, wherein the transparent material is a material selected from the group consisting of a polymer and a glass material.

9. The lighting device of claim 8, wherein the polymer is a material selected from the group consisting of a polymethyl methacrylate (PMMA), a polycarbonate (PC) and a polystyrene (PS).

10. The lighting device of claim 7, wherein the at least one sheet is formed from die-casting and hard baking a transparent material coated with a layer of ultraviolet (UV) glue.

11. The lighting device of claim 1, wherein the light source further comprises a luminous body and a reflecting screen.

12. The lighting device of claim 1, wherein the at least one sheet further comprises a heat conducting structure.

13. The lighting device of claim 12, wherein the heat conducting structure is a plurality of apertures.

14. The lighting device of claim 12, wherein the heat conducting structure is a plurality of recesses, each enabling an aperture to be formed between a screen and the at least one sheet while combining the screen with the sheet.

15. The lighting device of claim 1, wherein the microstructures of any two different arrays out of the plural arrays is specified according to a manner selected from the group consisting of: enabling the base width of a microstructure of one of the two arrays to be equal to that of another array; enabling the base width of a microstructure of one of the two array to be different from that of another array; and the combinations thereof.

* * * * *